United States Patent [19]

Curtis et al.

[11] 4,126,586

[45] Nov. 21, 1978

[54] PROCESS OF SPRAY DRYING NONIONIC SURFACTANT-CONTAINING DETERGENTS ALSO CONTAINING A CATIONIC NITROGEN COMPOUND

[75] Inventors: Michael Curtis; Richard L. Davies; John S. Galvin, all of Wirral, England

[73] Assignee: Lever Brothers Company, New York, N.Y.

[21] Appl. No.: 766,170

[22] Filed: Feb. 7, 1977

[30] Foreign Application Priority Data

Feb. 10, 1976 [GB] United Kingdom ..... 5122/76

[51] Int. Cl.[2] ..... C11D 1/835; C11D 11/02

[52] U.S. Cl. ..... 252/524; 252/528; 252/542; 252/547; 252/DIG. 1

[58] Field of Search ..... 252/528, 547, 524, 542, 252/DIG. 1

[56] References Cited

U.S. PATENT DOCUMENTS

| | | | |
|---|---|---|---|
| 3,403,107 | 9/1968 | Myerly | 252/524 |
| 3,607,763 | 9/1971 | Salmen et al. | 252/528 |
| 3,703,480 | 11/1972 | Grand | 252/524 |
| 3,741,913 | 6/1973 | Waag | 252/544 |
| 3,843,563 | 10/1974 | Davies et al. | 252/547 |

FOREIGN PATENT DOCUMENTS 2,239,522 2/1975 France.

*Primary Examiner*—Harris A. Pitlick

[57] ABSTRACT

The problem of autoxidation of detergent powders containing relatively large amounts of nonionic surfactants is reduced by incorporating in the crutcher slurry a compound containing a positively charged nitrogen atom. Such compounds should be present in an amount of from ½ to 6% of the resultant spray-dried powder. If desired they can be incorporated into the slurry by injection into the high pressure line to the spray-drying tower. Typical compounds containing positively charged nitrogen atoms are quaternary ammonium or organic heterocycle salts, amine oxides and betaines, although quaternary ammonium salts are preferred.

8 Claims, No Drawings

PROCESS OF SPRAY DRYING NONIONIC SURFACTANT-CONTAINING DETERGENTS ALSO CONTAINING A CATIONIC NITROGEN COMPOUND

The invention relates to improvements in a spray-drying process and to detergent powder produced by such a process.

Our British patent application No. 36593/73 and corresponding patent applications filed in other countries describe an improvement in the manufacture of detergent powders containing relatively high levels of nonionic surfactants by spray-drying in which an amino- or substituted amino containing compound is incorporated into the slurry to inhibit autoxidation. Examples of amino- or substituted amino-containing coupounds disclosed in that series of applications are alkanolamines such as etholamine, long chain alkanolamides such as coconut monethanolamides, proteins, amides such as acetamide and urea and simple amines such as hexamine.

We have now discovered that compounds which contain a positive nitrogen atom such as quaternary ammonium salts, amine oxides and betaines also inhibit autoxidation of nonionic surfactants during spray-drying. In some cases the degree of inhibition is markedly greater than that obtained using the amino- and substituted amino compounds.

Accordingly the present invention provides a process for preparing a spray-dried fabric-washing detergent powder substantially free from water-soluble calcium and magnesium salts comprising spray-drying a crutcher slurry containing from 4 to 20% by weight (based on the spray-dried powder) of a nonionic surfactant and 10 to 60% (based on the spray-dried powder) of a detergency builder, provided that when the builder consists solely of a phosphate salt, then it consists of anhydrous sodium tripolyphosphate containing at least 15% by weight of phase 1 material, or sodium tripolyphosphate which has been prehydrated, wherein the slurry is sprayed in the presence of from 1/4 to 6% (based on the spray-dried powder) of a compound containing a positively charged nitrogen atom.

The positive nitrogen compounds will normally be incorporated in the crutcher slurry either in solution or in suspension but may also be injected into a high pressure line carrying pressurised slurry to the spraying nozzles of a spray-drying tower.

If nonionic surfactant is being supplied to the spray-drying tower in that way, then the positive nitrogen compound can be dissolved in the surfactant and injected at the same time.

As stated above from about 1/4 to about 6%, preferably from about ½ to about 4% and most preferably from about 1 to 3% of the positive nitrogen compound will be used in the process, the percentages being based on the weight of the sprayed dried powder.

The amount of nonionic surfactant present in the slurry will be sufficient to provide from 4 to 20% by weight in the spray-dried powder. When all of the nonionic surfactant required in the spray-dried powder is incorporated into the slurry, then that will contain 12 to 20% by weight (based on the spray-dried powder) of nonionic surfactant. When part of the required nonionic surfactant is incorporated by another method, such as by spraying on to the spray-dried powder, or by using a preformed adjunct, then the slurry will contain 4 to 12% of nonionic surfactant based on the spray-dried powder.

As indicated above, the main types of positive nitrogen compounds are quaternary ammonium and heterocyclic salts, amine oxide and betaines.

The quaternary ammonium salts will be formed from anions which are compatible with the usual components of detergent compositions and which are biologically and environmentally acceptable. Thus they will normally be sulphates, chlorides or bromides, although other anions such as acetates, formates, methosulphates, ethosulphates and phosphates are not excluded.

The quaternary ammonium salts will have cations of the general formula

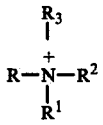

in which R, $R^1$ and $R^2$ and $R^3$ are the same or different straight or branched chain alkyl, alicyclic, alkaryl or aralkyl groups. Two or more of the group may be joined together so that the nitrogen atom is contained in an aliphatic or aromatic hererocyclic ring for example a pyridinium or imidazolinium ring.

Also the groups may contain ethylenic, oxyethylenic, amide and ester linkages, carbonyl groups and hydroxyl groups.

Specific examples of such compounds are:

$C_8$–$C_{22}$ alkyl trimethyl ammonium chlorides and bromides e.g. tallow, cetyl and stearyl trimethyl ammonium chlorides and bromides.

$C_8$–$C_{22}$ alkyl pyridinium chlorides and bromides e.g. lauryl and cetyl pyridinium chlorides and bromides.

N-(2-stearoyloxy-2-hydroxyethyl)trimethyl ammonium chloride.

N,N-di(stearoyloxyethyl)-N-methyl-N-ethyl ammonium ethosulphate.

di($C_{12}$–$C_{18}$) alkyl dimethyl ammonium chlorides and bromides e.g. distearyl dimethyl ammonium chlorides and bromides and dicoco dimethyl ammonium chloride and bromides.

N,N-di(laurylamidomenthyl)-N-N-dihydroxyethyl ammonium bromide.

di(2-stearoyloxyethyl)dimethyl ammonium chloride tallow trimethyl ammonium bromide.

Stearoyldimethylbenzyl ammonium chloride.

Quaternary ammonium salt cations containing more than one quaternary nitrogen atom are also suitable for use in this invention. Examples of these are diquaternary ammonium salts of the general formula

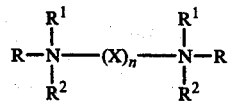

in which R, $R^1$ and $R^2$ are as defined above, X is a linking group, preferably an alkylene, ethyleneoxy or propyleneoxy linking group, and *n* is from 1 to 10.

Amine oxides have the general formula $$RR^1R^2N \rightarrow O$$

where R, $R^1$ and $R^2$ are as defined above. Preferably one of R, $R^1$ and $R^2$ is a $C_{10-22}$ alkyl or alkenyl group and $R^1$ and $R^2$ are $C_1$–$C_4$ alkyl groups or $C_2$ or $C_3$ hydroxy alkyl groups. Specific amine oxides which may be mentioned are dimethyl hardened tallow amine oxide and dimethyl cocoamine oxide. Compounds with hetero cyclic or phenyl groups in the structure which may be mentioned are dimethyl $C_8$–$C_{18}$ alkyl benzyl amine oxide and N-alkyl morpholine N-oxide.

Betaines are the third class of coupounds containing a positive nitrogen atom which are suitable for use in this invention. Betaines which are suitable for use in detergent compositions generally contain carboxylic or sulphonic acid head groups together with a $C_8$–$C_{22}$, preferably $C_{12}$–$C_{18}$ alkyl group. Specific betaines containing the sulphonic acid group (sulphobetaines) are ($C_{10}$–$C_{18}$) alkyl di ($C_1$–$C_4$) alkyl aminio ($C_2$–$C_3$) alkyl or hydroxy alkyl sulphonates, e.g. N-hexadecyl-N-N-dimethyl ammonio propane sulphonate and the correspondong hydroxy propane compound, gamma and delta-pyridino ($C_{10}$–$C_{18}$) alkane sulphonate and gamma and delta-pyridino ($C_{10}$–$C_{18}$) alkane sulphonates, and gamma and delta-tri ($C_1$–$C_4$) alkyl ammonio ($C_{10}$–$C_{18}$) alkane sulphonates.

The carboxybetaines which are similar in structure to the sulphobetaines mentioned above except that they contain carboxylic acid groups instead of sulphonic acids may also be used. An example of such a compound is a ($C_{10}$–$C_{18}$) alkyl di ($C_1$–$C_4$) alkyl ammonio ($C_2$–$C_3$) alkane carboxylate such as tallowalkyl dimethyl ammonio propionate.

Instead of $C_{10}$–$C_{18}$ alkyl groups, $C_{10}$–$C_{18}$ hydroxyalkyl groups which can contain amide, ester linkages, or ethyleneoxy linkages, may be used. Instead of $C_1$–$C_4$ alkyl groups, $C_1$–$C_4$ hydroxyalkyl groups may be used.

Also, imidazolinium salts can be used. An example of such a salt, which we have found effective is produced by Rewo Chemie GmbH under the name Steinquat M5040. This is believed to have a structural formula

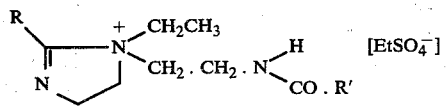

where R and R′ are $C_1$ to $C_{12}$ alkyl groups.

The problem which this invention sets out to solve is concerned with spray-drying a slurry containing a relatively high level of a nonionic surfactant. Indeed the slurry should be substantially free of anionic surfactants since we have discovered that even a minor amount of anionic surfactant can adversely affect the high level of detergency which nonionic surfactants can provide. Nevertheless it may be necessary or desirable to incorporate a soap into the slurry in order to facilitate spray-drying to a powder having a sufficiently low bulk density. Additionally alkyl phosphate may be incorporated into the slurry or injected directly into the tower via a high pressure line together with a proportion of the nonionic in order to control the lather produced by the finished powder. Therefore the general statement that anionic surfactant should not be present is qualified by the rider that soap and alkyl phosphate are permitted, but they are not relied on to perform a surfactant effect.

The invention is particularly applicable to the spray-drying of powders containing nonionic surfactants of the alkoxylated phenol and alkoxylated alcohol type although other nonionic surfactants which give powders susceptible to autoxidation will also exhibit the improvement.

The phenols which are used as the hydrophobic portion of the nonionic are preferably alkylphenols in which the alkyl group contains 6–12 carbon atoms.

The alcohols used can be primary or secondary alcohols containing straight or branched carbon chains. The number of carbon atoms will generally be from about 7 to about 24, preferably from about 8 to 18 and most preferably from about 11 to 16. These alcohols may be the so-called synthetic alcohols made by the well known Ziegler or Oxo processes, or the so-called "natural alcohols".

The alkoxylation reaction will be carried out by conventional means, generally using ethylene oxide or propylene oxide or both. The degree of ethoxylation can vary widely both from one hydrophobe to the other and even when using a single hydrophobe. Thus ethylene oxide chains containing as few as 1 and more than 20 ethylene oxide units are quite often found in nonionic surfactants and will be applicable here.

The choice of carbon chain length of the hydrophobe and the chain length of the hydrophobic alkoxy chain is largely determined by the detergent properties required of the molecule. The relationship between the chain length of the hydrophobic part of the molecule and that of the hydrophilic part can be expressed numerically as the hydrophilic-lipophilic balance (HLB). A rough and ready way of determining the HLB of alcohol ethoxylate is to use the expression HLB + Wt percentage of ethylene oxide/5.

Nonionic surfactants which are suitable for use in heavy duty fabric washing powders generally have an HLB in the range 9 to 16, although HLBs outside this range are not excluded.

An additional factor in the choice of nonionic surfactant is that alcohols containing both short carbon and short ethoxylate chain lengths are relatively low boiling and can volatilise under the conditions prevailing in a spray-drying tower.

Preferred alcohol ethoxylates for use in this invention are derived from the following series.

Tergitols (Trade Mark) which are a series of ethoxylates of secondary alcohols sold by the Union Carbide Corporation, especially Tergitol 15-S-7, 15-S-9, 15-S-12 and 15-S-15 which are ethoxylates of a mixture of C11-15 alcohols and Tergitols 45-S-7, 45-S-9, 45-S-12 and 45-S-15 which are ethoxylates of a mixture of C14 and C15 alcohols, the degree of ethoxylation being shown by the postscript.

Ethoxylates of primary alcohols made by the Oxo process and containing about 20% of alpha branched material sold by Shell Chemicals Ltd and Shell Chemicals Inc as Dobanols and Neodols (registered Trade Marks) respectively, especially Dobanol and Neodol 25-7, 25-9, 25-12 and 25-15 which are ethoxylates of a mixture of $C_{12}$–$C_{15}$ alcohols and Dobanol 45-7, 45-9, 25-12 and 25-15 which are ethoxylates of a mixture of $C_{14-15}$ alcohols.

Ukanils (Trade Mark) which are a series of ethoxylates of Oxo alcohols containing about 25% of alpha methyl branched and about 10% of ethyl branched material and Acropols (Trade Mark) manufactured by Ugine Kuhlman et Cie, especially Acropol 35-7, 35-9, 35-11 and 35-15 which are derived from a mixture of $C_{13}$–$C_{15}$ alcohols.

Synperonics (Trade Mark), a series of ethoxylates of alcohols containing 45–55% of alkyl branching, mostly methyl branching, sold by Imperial Chemical Industries Limited, especially those based on a $C_{13-15}$ mixture of alcohols and ethoxylated to 7, 9, 11 and 15 units of ethylene oxide.

Ethoxylates of primary Ziegler alcohols Alfols (Trade Mark) derived by oxidative polymerisation of ethylene, manufactured by Conoco-Condea, especially Alfol 12/14-7, 12/14-9, 12/14-12, 12/14-15 and Alfol 14/12-7, 14/12-9, 14/12-12, 14/12-15 which are ethoxylates of mixtures of $C_{12}$ and $C_{14}$ alcohols.

Lastly, ethoxylates of primary Oxo alcohols about 50% branched, mainly $\alpha$ methyl sometimes called Lials (Trade Mark) produced from olefins manufactured by Liquichimica.

The required HLB can be achieved not only by selecting the carbon chain length of the hydrophobe and the length of the ethyleneoxy chain in a single or substantially single material (because of the nature of their process of production, all nonionic surfactants which are spoken of as if they were single substances are in fact mixtures). It can also be achieved by deliberately taking two "substances" of widely differing HLBs and mixing them. This approach is described in Netherlands patent application No. 7413522 and the Netherlands patent application No. 7406003. It is also possible to obtain the required HLB by "stripping" some chain lengths from a nonionic surfactant mixture as described in patent applications based on U.S. Ser. No. 453,464 and U.S. Pat. No. 3,682,849.

Conventional ingredients on conventional amounts can be incorporated into the slurry which is spray-dried in accordance with the invention. However we have discovered that it is desirable to exclude from the composition water-soluble calcium and magnesium salts, since these appear to detract from the detergency and rinsability of the product.

Thus it was suggested earlier that soap could be incorporated to help to reduce the bulk density of the powder. The term "soaps" is intended to include alkali metal salts such as the sodium and potassium salts as well as ammonium and alkanolaminium salts of fatty acids containing from about 8 to about 26 carbon atoms, preferably 10 to 22 carbon atoms. The most usual soaps for industrial use are the sodium and potassium salts of tallow and coconut fatty acids and mixtures thereof, and these and hardened rape-seed oil soaps are preferred in this invention. Soap may be present in an amount of up to about 3% by weight of the spray-dried powder.

In addition the slurry can and normally will contain detergency builders in an amount up to about 75% by weight of the spray-dried powder, preferably 10–60% and most preferably 30–60%. Any of the builders which have been suggested in the art may be used, for example the water soluble salts of ortho-, pyro- and tripolyphosphates, carbonates, bicarbonates and silicates, especially the sodium salts. However, when the detergency builder which is selected is a phosphate salt alone, that is when no non-phosphate detergency builder is used, we have found it desirable to use sodium tripolyphosphate rich in the phase 1 form, or alternatively to use material which has been pre-hydrated to a maximum of about 4% by weight. Preferably, the degree of prehydration will be at least 1% by weight, more preferably at least 2%. In this way a spray-dried powder having satisfactory flow characteristics can be obtained consistently. The combination of sodium tripolyphosphate with alkaline sodium silicate, that is sodium silicate having an $Na_2O:SiO_2$ ratio in the range 1:1.6 to 1:2.0 has been found especially useful, although combinations with silicates having different $Na_2O:SiO_2$ ratios are not excluded.

The builders which have been suggested in responses to pressure to reduce the phosphorus content of detergents are also suitable for use with the process of this invention. For example the salts, especially sodium salts of ethylene diamine tetraacetic acid, nitrilotriacetic acid, oxydissucinic acid, citric acid, oxydiacetic acid, alkenyl succinic acid, polyacrylic acid, hydrofuran tetracarboxylic acid, alkylaryl succinic and malonic acids, dipicolinic acid, alkane disulphonic acid, sulphosuccinic acid, and alkyl phthalic acid are all suitable. Other builder materials which can be used include oxidised polysaccharides, especially oxidised starch carboxymethyloxysuccinates and their hydrates and analogues, sulphonated fatty acid salts, aluminosilicates and "seed" builders such as the carbonate/calcite combination.

Other components of detergent compositions can be added to the slurry or post-dosed into the spray-dried base powder according to their known suitability for undergoing a spray-drying process.

Examples of such components are oxidising bleaches such as sodium perborate and percarbonate optionally with bleach precursors such as tetra acetyl ethylene diamine, and tetra acetyl glycoluril, suds suppressors such as silicone oils, alkyl phosphates and microcrystalline waxes, soil suspending agents such as sodium carboxymethyl cellulose, cellulose ethers and copolymers of maleic anhydride with ethylene or methyl vinyl ether, enzymes such as those sold under the trade names "Alcalase", "Esterase" and "SP72" by Novo Industries A/S, Denmark, and Fluorescers.

These conventional and optional components of the detergent compositions can be present together in an amount of from 15 to 50% by weight of the finished composition when an oxidising bleach is present or at substantially lower levels in the absence of such bleach.

The following example illustrates the effect of positive nitrogen-containing compounds in inhibiting autoxidation of detergent compositions containing relatively high levels of nonionic surfactants.

EXAMPLE 1

In this example, the time taken for a sample of detergent powder to autoxidise at a given temperature was measured by a modification of the method of PC Bowes and A Cameron described in J Appl Chem and Biotechnol, 1971. This method involves suspending cubic open-topped baskets of 10cm side containing the powder in an oven set to the temperature required. The powder has a thermocouple embedded in it, close to the centre of the cube connected to a chart recorder. When autoxidation sets in a rapid rise in temperature occurs.

Slurries were made up and spray-dried to produce a powder having the following formulations

| | % by weight | | | | | |
|---|---|---|---|---|---|---|
| | A | B | C | D | E | F |
| Nonionic Surfactant[1] | 14.0 | → | | | | |
| Sodium Soap[2] | 1.0 | → | | | | |
| Sodium Tripolyphosphate | 46.0 | → | | | | |

-continued

| | % by weight | | | | | |
|---|---|---|---|---|---|---|
| | A | B | C | D | E | F |
| Alkaline sodium silicate | 7.0 | → | | | | |
| Sodium sulphate | 13.0 | → | | | | |
| Sodium carboxymethyl cellulose | 1.0 | → | | | | |
| Coconut monoethanolamide | — | 2.0 | — | — | — | — |
| Arquad 2C[3] | — | — | 2.0 | — | — | — |
| Arquad 2HT[4] | — | — | — | 2.0 | — | — |
| Steinquat M5040[5] | — | — | — | — | 2.0 | — |
| Sapamine OC[6] | — | — | — | — | — | 2.0 |
| Minors and Moisture | balance to 100 | | | | | |

[1] The nonionic surfactant was "Synperonic 7" which has been described earlier.
[2] The sodium soap was "Pristerine 4916" (registered Trade Mark) available from Prices Chemicals Ltd, Bromborough, Wirral, Merseyside, England.
[3] & [4] Arquad 2C and 2HT (registered Trade Marks) are manufactured by Armour-Hess Ltd, Arquad 2C is dicoco dimethylammonium chloride and Arquad 2HT is di(hardened tallow) dimethylammonium chloride.
[5] Steinquat M5040 (registered Trade Mark) is a compound of the formula

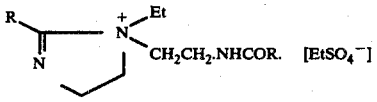

where R and $C_{1-12}$ alkyl groups manufactured by Rewo Chemie GmbH.
[6] Sapamine OC (registered Trade Mark) is a compound of the general formula $RCONHCH_2NHME_2 \cdot [CH_3CO_2^-]$ manufactured by Ciba-Geigy Ltd.

The time to autoxidation of the four powders was measured as described with the following results

| Powder | Time to autoxidation (hrs) | |
|---|---|---|
| A | 2½ | at 150° C |
| B | 3 | |
| C | > 48 | |
| D | > 48 | |
| E | 14½ | |
| F | 12½ | |

This demonstrates the superior inhibition of autoxidation which can be obtained by spray-drying detergent containing relatively high levels of nonionic surfactants in the presence of compounds containing a positive nitrogen atom.

EXAMPLE 2

The following test was performed to determine, qualitatively, the extent to which a given compound containing a positively charged nitrogen atom inhibits autoxidation of nonionic surfactants.

A 10 gm sample of the nonionic surfactant and 0.3 gms of the compound under test was placed in a 100 ml beaker which was heated to 40° C. and maintained at this temperature by means of a thermostatically controlled oven. At intervals of time an aliquot of the contents of the beaker was removed. The hydroperoxide and peroxide content of the aliquot was determined by titration with iodide/sodium thiosulphate in a conventional manner. A second aliquot was reacted with excess sodium hydroxide solution which was back titrated with acid, also in a known manner, to obtain a measure of the saponification value of the sample. (It should be explained that esters are also formed during the autoxidation process.) These two measurements give a good indication of the extent to which a given compound inhibits autoxidation. These results obtained were as follows:

In all the following tables, "P" refers to the hydroperoxide and peroxide content in milliequivalents of oxygen per kg of sample "S" refers to the saponification values in milligrams of potassium hydroxide per gram of sample.

Table 1

Nonionic Surfactant: Alfol 14/12 8EO, a mixture of $C_{12}$ and $C_{14}$ primary Ziegler alcohols, ethoxylated to an average of 8 moles of ethylene oxide per mole of alcohol.

| | Time (days) | | | | | | | |
|---|---|---|---|---|---|---|---|---|
| | 6 | | 15 | | 22 | | 35 | |
| N+ Compound (3%) | P | S | P | S | P | S | P | S |
| Arquad 2HT | 5 | 3 | 8 | 4 | 15 | 6 | 18 | 9 |
| Ethoquad C25 | 10 | 3 | 15 | 5 | 13 | 7 | 25 | 11 |
| Arquad 2C | 8 | 2 | 13 | 4 | 13 | 8 | 20 | 8 |
| Nil | 40 | 4 | 78 | 11 | 153 | 19 | 315 | 31 |

Table 2

Nonionic Surfactant : Lial 125 8EO, a 50% primary Oxo alcohol having an average carbon chain length of 12 carbon atoms ethoxylated with an average of 8 moles of ethylene oxide per mole of alcohol.

| | Time (days) | | | | | | | |
|---|---|---|---|---|---|---|---|---|
| | 4 | 13 | 12 | 12 | 25 | 32 | 38 | 38 |
| N+ Compound | P | S | P | S | P | S | P | S |
| Arquad 2HT | <2 | 3.2 | <2 | 1.0 | 2 | 1.0 | 6 | — |
| Dimethyl-ammonium chloride | <2 | 10.9 | <2 | — | <2 | 8.6 | 4 | — |
| Cetyltrimethyl-ammonium bromide | <2 | 5.3 | <2 | — | <2 | 1.1 | 3 | — |
| Tetramethyl-ammonium bromide | <2 | 2.0 | <2 | — | <2 | 1.4 | 4 | — |
| Nil | 5 | 8.8 | 33 | — | 91 | 20.4 | 182 | — |

Table 3

Tergitol 15-S-9, a mixture of secondary alcohols having carbon chain lengths in the $C_{12}$ to $C_{15}$ region, ethoxylated with an average of 9 moles of ethylene oxide per mole of alcohol.

| | Time (days) | | | | | |
|---|---|---|---|---|---|---|
| | 5 | 12 | 14 | 27 | 34 | 40 |
| N+ Compound | P | P | S | P | S | P |
| Arquad 2HT | 20 | 5 | 15.8 | 13 | 57 | 29.7 |
| Ethoquad C25 | 13 | 20 | 22.7 | 90 | 118 | 43.4 |
| Arquad 2C | 8 | 5 | 12.2 | 8 | 29 | 23.6 |
| Nil | 50 | 100 | 23.2 | 168 | 302 | 58.0 |

In the above tables, Ethoquad C25 (registered Trade Mark of Armour-Hess Chemicals Limited) is an ethoxylated quaternary ammonium chloride. The other compounds used were supplied as substantially pure substances by British Drug Houses Ltd.

Example 3

A spray-dried detergent powder having the composition of formulation A of Example 1 was sprayed with 2% by weight of the substances shown in the following table. The resultant sprayed powder was then tested in accordance with the procedure set out in Example 1 with the following results

| Substance sprayed (2%) | Time to autoxidation (hrs) | |
|---|---|---|
| Arquad 18/50[7] | 24 | at 150° C |
| Pyridinium thiosulphobetaine[8] | 24 | |

[7]Arquad 18/50 (registered Trade Mark) is a dialkyl dimethyl ammonium chloride produced by Armour-Hess Ltd.
[8]This compound has the formula

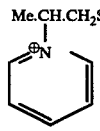

Again, the results of this model experiment demonstrate the effectiveness of compounds containing a positively-charged nitrogen atom in reducing the tendency of detergent powders containing a relatively large amount of nonionic surfactant to autoxidise.

What is claimed is:

1. A process for preparing a spray-dried fabric-washing detergent powder substantially free from water-soluble calcium and magnesium salts which comprises:
   (a) forming an aqueous slurry comprising from 4 to 20% by weight, based on the spray-dried powder, of a nonionic surfactant and from 10 to 60% based on the spray-dried powder of a non-phosphate detergency builder, or a mixture of a non-phosphate detergency builder with a phosphate detergency builder; and
   (b) spray-drying the slurry to form a spray-dried powder, wherein the process comprises the step of spraying the slurry in the presence of from 1/4 to 6% by weight, based on the spray-dried powder, of a compound containing a positively charged nitrogen atom selected from quaternary ammonium salts, imidazolinium salts and betaines.

2. A process according to claim 1 wherein the nonionic surfactant is present in the slurry in an amount of from 4 to 12% by weight of the spray-dried powder.

3. A process according to claim 2 wherein the nonionic surfactant is present in the slurry in an amount of from 12 to 20% by weight of the spray-dried powder.

4. A process according to claim 1 wherein the compound containing a positively charged nitrogen atom is present in the slurry in an amount of from ½ to 3% by weight of the spray-dried powder.

5. A process according to claim 1 wherein the quaternary ammonium compound is a dicoco-dimethylammonium chloride or bromide, a di(hardened tallow) dimethyl ammonium chloride or bromide or a mixture of such compounds.

6. A process according to claim 1 wherein the nonionic surfactant comprises a $C_8$ to $C_{18}$ Ziegler or Oxo alcohol ethoxylated with from 5 to 20 moles per mole of alcohol, of ethylene oxide.

7. A process according to claim 1 wherein the compound containing a positive nitrogen atom is injected into a high pressure line carrying pressurised slurry to the spraying nozzles of a spraying tower.

8. A process for preparing a spray-dried fabric-washing detergent powder substantially free from water-soluble calcium and magnesium salts which comprises:
   (a) forming an aqueous slurry comprising 4 to 20% by weight, based on the spray-dried powder, of a nonionic surfactant and from 10 to 60% based on the spray-dried powder of a phosphate detergency builder consisting of anhydrous sodium tripolyphosphate containing at least 15% by weight of phase 1 material, or consisting of sodium tripolyphosphate which has been prehydrated; and
   (b) spray-drying the slurry to form a spray-dried powder wherein the process comprises the step of spraying the slurry in the presence of from ¼ to 6% by weight, based on the spray-dried powder, of a compound containing a positively charged nitrogen atom selected from quaternary ammonium salts, imidazolinium salts, and betaines.

* * * * *